US011292991B2

(12) United States Patent
Wang et al.

(10) Patent No.: US 11,292,991 B2
(45) **Date of Patent: *Apr. 5, 2022**

(54) DISPERSANT POLYMER FOR AUTODISH FORMULATIONS

(71) Applicants: Dow Global Technologies LLC, Midland, MI (US); Rohm and Haas Company, Collegeville, PA (US)

(72) Inventors: Lin Wang, Furlong, PA (US); Anurima Singh, Manvel, TX (US); Scott Backer, Phoenixville, PA (US); Wei Gao, Fort Washington, PA (US); Steven G. Arturo, Bala Cynwyd, PA (US); Ivan A. Konstantinov, Manvel, TX (US); Paul Mercando, Pennsburg, PA (US)

(73) Assignees: Dow Global Technologies LLC, Midland, MI (US); Rohm and Haas Company, Collegeville, PA (US)

( * ) Notice: Subject to any disclaimer, the term of this patent is extended or adjusted under 35 U.S.C. 154(b) by 60 days.

This patent is subject to a terminal disclaimer.

(21) Appl. No.: 16/757,554

(22) PCT Filed: Oct. 18, 2018

(86) PCT No.: PCT/US2018/056438

§ 371 (c)(1),
(2) Date: Apr. 20, 2020

(87) PCT Pub. No.: WO2019/099145

PCT Pub. Date: May 23, 2019

(65) Prior Publication Data

US 2021/0198599 A1 Jul. 1, 2021

Related U.S. Application Data

(60) Provisional application No. 62/586,296, filed on Nov. 15, 2017.

(51) Int. Cl.

| | |
|---|---|
| ***C11D 1/72*** | (2006.01) |
| ***C11D 3/08*** | (2006.01) |
| ***C11D 3/33*** | (2006.01) |
| ***C11D 3/37*** | (2006.01) |
| ***C11D 3/10*** | (2006.01) |
| ***C11D 3/20*** | (2006.01) |
| ***C11D 3/32*** | (2006.01) |
| ***C11D 11/00*** | (2006.01) |
| ***C11D 3/395*** | (2006.01) |

(52) U.S. Cl.

CPC ..... *C11D 3/3761* (2013.01); *C11D 1/72* (2013.01); *C11D 3/08* (2013.01); *C11D 3/10* (2013.01); *C11D 3/2086* (2013.01); *C11D 3/32* (2013.01); *C11D 3/3757* (2013.01); *C11D 3/3765* (2013.01); *C11D 3/3788* (2013.01); *C11D 3/3951* (2013.01); *C11D 11/0023* (2013.01)

(58) Field of Classification Search

CPC ..... C11D 3/08; C11D 3/10; C11D 3/3757; C11D 3/3765; C11D 3/3788; C11D 3/3951

USPC ..... 510/220, 221, 229, 230, 370, 475, 477, 510/509, 511

See application file for complete search history.

(56) References Cited

U.S. PATENT DOCUMENTS

| | | | | |
|---|---|---|---|---|
| 5,431,846 | A | 7/1995 | Christopher et al. | |
| 11,015,147 | B2 * | 5/2021 | Wang | C11D 3/3761 |

FOREIGN PATENT DOCUMENTS

| | | |
|---|---|---|
| EP | 0634428 B1 | 10/1998 |
| EP | 2366768 | 9/2011 |
| EP | 2963069 | 1/2016 |
| GB | 771791 | 4/1957 |
| WO | 2015138872 | 9/2015 |

* cited by examiner

*Primary Examiner* — Gregory R Delcotto
(74) *Attorney, Agent, or Firm* — Thomas S. Deibert

(57) ABSTRACT

An automatic dishwashing composition is provided including a builder selected from the group consisting of carbonate, bicarbonate, citrate, silicate and mixtures thereof; a nonionic surfactant; and a dispersant polymer comprising: (a) 5 to 75 wt % of structural units of itaconic acid; (b) 10 to 85 wt % of structural units having formula I (I)

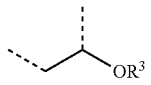

wherein each $R^3$ is independently selected from a hydrogen and a —C(O)$CH_3$ group; and (c) 10 to 65 wt % of structural units of (meth)acrylic acid; wherein the dispersant polymer has a lactone end group and wherein the dispersant polymer has a weight average molecular weight of 1,500 to 6,000.

8 Claims, No Drawings

DISPERSANT POLYMER FOR AUTODISH FORMULATIONS

The present invention relates to a dispersant polymer for use in automatic dish washing formulations. In particular, the present invention relates to automatic dishwashing compositions incorporating a dispersant polymer having reduced spotting and/or filming.

Automatic dishwashing compositions are generally recognized as a class of detergent compositions distinct from those used for fabric washing or water treatment. Automatic dishwashing compositions are expected by users to produce a spotless and film-free appearance on washed articles after a complete cleaning cycle.

Phosphate-free automatic dishwashing compositions are increasingly desirable. Phosphate-free automatic dishwashing compositions typically rely on non-phosphate builders, such as salts of citrate, carbonate, silicate, disilicate, bicarbonate, aminocarboxylates and others to sequester calcium and magnesium from hard water, and upon drying, leave an insoluble visible deposit.

A family of polycarboxylate copolymers and their use as builders in detergent compositions and rinse aid compositions is disclosed by Christopher et al. in U.S. Pat. No. 5,431,846 for use in the final rinse step of a dish or warewashing machine. Christopher et al. disclose block copolymers comprising from 20 to 95 mole % of monomer units derived from itaconic acid or a homologue thereof and from 5 to 80 mole % of monomer units derived from vinyl alcohol or a lower vinyl ester are excellent binders of divalent or polyvalent metals and are useful as potentially biodegradable builders in detergent compositions as well as in machine dishwashing compositions and anti-scaling rinse compositions.

Notwithstanding there remains a need for new automatic dishwashing compositions that are amenable to phosphate-free application while providing reduced filming and/or spotting performance in use.

The present invention provides an automatic dishwashing composition, comprising: a builder selected from the group consisting of carbonate, bicarbonate, citrate, silicate and mixtures thereof; a nonionic surfactant; and a dispersant polymer comprising: (a) 5 to 75 wt % of structural units of itaconic acid; (b) 10 to 85 wt % of structural units having formula I

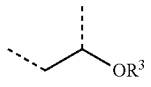

(I)

wherein each $R^3$ is independently selected from a hydrogen and a —C(O)$CH_3$ group; and (c) 10 to 65 wt % of structural units of (meth)acrylic acid; wherein the dispersant polymer has a lactone end group and wherein the dispersant polymer has a weight average molecular weight of 1,500 to 6,000.

The present invention provides an automatic dishwashing composition, comprising: a builder selected from the group consisting of carbonate, bicarbonate, citrate, silicate and mixtures thereof; a nonionic surfactant; and a dispersant polymer comprising: (a) 5 to 75 wt % of structural units of itaconic acid; (b) 10 to 85 wt % of structural units having formula I, wherein each $R^3$ is independently selected from a hydrogen and a —C(O)$CH_3$ group; and (c) 10 to 65 wt % of structural units of (meth)acrylic acid; wherein the dispersant polymer has a lactone end group; wherein the dispersant polymer has a weight average molecular weight of 1,500 to 6,000; and wherein the automatic dishwashing composition contains less than 0.1 wt % phosphate, measured as elemental phosphorus.

The present invention provides an automatic dishwashing composition, comprising: a builder selected from the group consisting of carbonate, bicarbonate, citrate, silicate and mixtures thereof; a nonionic surfactant; and a dispersant polymer comprising: (a) 5 to 75 wt % of structural units of itaconic acid; (b) 10 to 85 wt % of structural units having formula I, wherein each $R^3$ is independently selected from a hydrogen and a —C(O)$CH_3$ group; and (c) 10 to 65 wt % of structural units of (meth)acrylic acid; wherein the dispersant polymer has a lactone end group; wherein the dispersant polymer has a weight average molecular weight of 1,500 to 6,000; and wherein the automatic dishwashing composition contains 0 wt % of builders selected from the group consisting of nitrilotriacetic acid; ethylenediaminetetraacetic acid; diethylenetriaminepentaacetic acid; glycine-N,N-diacetic acid; methyl glycine-N,N-diacetic acid; 2-hydroxyethyliminodiacetic acid; glutamic acid-N,N-diacetic acid; 3-hydroxy-2,2'-iminodissuccinate; S,S-ethylenediaminedisuccinate aspartic acid-diacetic acid; N,N'-ethylene diamine disuccinic acid; iminodisuccinic acid; aspartic acid; aspartic acid-N,N-diacetic acid; beta-alaninediacetic acid; polyaspartic acid; salts thereof and mixtures thereof.

The present invention provides an automatic dishwashing composition, comprising: a builder selected from the group consisting of carbonate, bicarbonate, citrate, silicate and mixtures thereof; a nonionic surfactant; and a dispersant polymer comprising: (a) 5 to 75 wt % of structural units of itaconic acid; (b) 10 to 85 wt % of structural units having formula I, wherein each $R^3$ is independently selected from a hydrogen and a —C(O)$CH_3$ group; and (c) 10 to 65 wt % of structural units of (meth)acrylic acid; wherein the dispersant polymer has a lactone end group; wherein the dispersant polymer has a weight average molecular weight of 1,500 to 6,000; wherein the automatic dishwashing composition contains 0 wt % of builders selected from the group consisting of nitrilotriacetic acid; ethylenediaminetetraacetic acid; diethylenetriaminepentaacetic acid; glycine-N,N-diacetic acid; methyl glycine-N,N-diacetic acid; 2-hydroxyethyliminodiacetic acid; glutamic acid-N,N-diacetic acid; 3-hydroxy-2,2'-iminodissuccinate; S,S-ethylenediaminedisuccinate aspartic acid-diacetic acid; N,N'-ethylene diamine disuccinic acid; iminodisuccinic acid; aspartic acid; aspartic acid-N,N-diacetic acid; beta-alaninediacetic acid; polyaspartic acid; salts thereof and mixtures thereof; and wherein the automatic dishwashing composition contains less than 0.1 wt % phosphate, measured as elemental phosphorus.

The present invention provides an automatic dishwashing composition, comprising: a builder selected from the group consisting of carbonate, bicarbonate, citrate, silicate and mixtures thereof; a nonionic surfactant; and a dispersant polymer comprising: (a) 5 to 75 wt % of structural units of itaconic acid; (b) 10 to 85 wt % of structural units having formula I, wherein each $R^3$ is independently selected from a hydrogen and a —C(O)$CH_3$ group; and (c) 10 to 65 wt % of structural units of (meth)acrylic acid; wherein the dispersant polymer has a lactone end group; wherein the dispersant polymer has a weight average molecular weight of 1,500 to 6,000; wherein the automatic dishwashing composition contains 0 wt % of builders selected from the group consisting of nitrilotriacetic acid; ethylenediaminetetraacetic acid; diethylenetriaminepentaacetic acid; glycine-N,N-diacetic acid; methyl glycine-N,N-diacetic acid; 2-hydroxyethyliminodiacetic acid; glutamic acid-N,N-diacetic acid; 3-hydroxy-2,2'-iminodissuccinate; S,S-ethylenediaminedisuccinate aspartic acid-diacetic acid; N,N'-ethylene diamine disuccinic acid; iminodisuccinic acid; aspartic acid; aspartic acid-N,N-diacetic acid; beta-alaninediacetic acid; polyaspartic acid; salts thereof and mixtures thereof; wherein the automatic dishwashing composition contains less than 0.1 wt % phosphate, measured as elemental phosphorus; and wherein the lactone end group is a γ-lactone.

The present invention provides an automatic dishwashing composition, comprising: a builder selected from the group consisting of carbonate, bicarbonate, citrate, silicate and mixtures thereof; a nonionic surfactant; and a dispersant polymer comprising: (a) 5 to 75 wt % of structural units of itaconic acid; (b) 10 to 85 wt % of structural units having formula I, wherein each $R^3$ is independently selected from a hydrogen and a —C(O)$CH_3$ group; and (c) 10 to 65 wt % of structural units of (meth)acrylic acid; wherein the dispersant polymer has a lactone end group; wherein the dispersant polymer has a weight average molecular weight of 1,500 to 6,000; wherein the automatic dishwashing composition contains 0 wt % of builders selected from the group consisting of nitrilotriacetic acid; ethylenediaminetetraacetic acid; diethylenetriaminepentaacetic acid; glycine-N,N-diacetic acid; methyl glycine-N,N-diacetic acid; 2-hydroxyethyliminodiacetic acid; glutamic acid-N,N-diacetic acid; 3-hydroxy-2,2'-iminodissuccinate; S,S-ethylenediaminedisuccinate aspartic acid-diacetic acid; N,N'-ethylene diamine disuccinic acid; iminodisuccinic acid; aspartic acid; aspartic acid-N,N-diacetic acid; beta-alaninediacetic acid; polyaspartic acid; salts thereof and mixtures thereof; wherein the automatic dishwashing composition contains less than 0.1 wt % phosphate, measured as elemental phosphorus; wherein the lactone end group is a γ-lactone; and wherein the dispersant polymer has formula II (II)

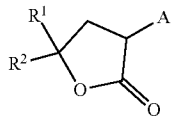

wherein A is a polymer chain comprising the structural units of itaconic acid, the structural units of vinyl acetate and the structural units of (meth)acrylic acid; wherein $R^1$ is methyl; and wherein $R^2$ is methyl.

The present invention provides a method of cleaning an article in an automatic dishwashing machine, comprising: providing at least one article; providing an automatic dishwashing composition according to the present invention; and, applying the automatic dishwashing composition to the at least one article.

DETAILED DESCRIPTION

When incorporated in automatic dishwashing compositions (particularly phosphate-free automatic dishwashing compositions), the dispersant polymer of the present invention as particularly described herein dramatically improve the antispotting performance and filming performance of the automatic dishwashing composition.

Unless otherwise indicated, ratios, percentages, parts, and the like are by weight. Weight percentages (or wt %) in the composition are percentages of dry weight, i.e., excluding any water that may be present in the composition. Percentages of monomer units in the polymer are percentages of solids weight, i.e., excluding any water present in a polymer emulsion.

As used herein, unless otherwise indicated, the terms "weight average molecular weight" and "Mw" are used interchangeably to refer to the weight average molecular weight as measured in a conventional manner with gel permeation chromatography (GPC) and conventional standards, such as polystyrene standards. GPC techniques are discussed in detail in Modem Size Exclusion Chromatography, W. W. Yau, J. J. Kirkland, D. D. Bly; Wiley-Interscience, 1979, and in A Guide to Materials Characterization and Chemical Analysis, J. P. Sibilia; VCH, 1988, p. 81-84. Weight average molecular weights are reported herein in units of Daltons.

The term "ethylenically unsaturated" as used herein and in the appended claims describes molecules having a carbon-carbon double bond, which renders it polymerizable. The term "multi-ethylenically unsaturated" as used herein and in the appended claims describes molecules having at least two carbon-carbon double bonds.

As used herein the term "(meth)acrylic" refers to either acrylic or methacrylic.

The terms "Ethyleneoxy" and "EO" as used herein and in the appended claims refer to a —$CH_2$—$CH_2$—O— group.

The term "phosphate-free" as used herein and in the appended claims means compositions containing ≤1 wt % (preferably, ≤0.5 wt %; more preferably, ≤0.2 wt %; still more preferably, ≤0.1 wt %; yet still more preferably, ≤0.01 wt %; most preferably, less than the detectable limit) of phosphate (measured as elemental phosphorus).

The term "structural units" as used herein and in the appended claims refers to the remnant of the indicated monomer; thus a structural unit of acrylic acid is illustrated:

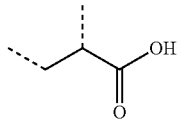

where the dotted lines represent the points of attachment to the polymer backbone.

Preferably, the automatic dishwashing composition of the present invention, comprises: a builder (preferably, 1 to 97 wt %; more preferably ≥1 wt %; still more preferably, ≥10 wt %; yet still more preferably, ≥20 wt %; most preferably, ≥25 wt %; preferably, ≤95 wt %; more preferably, ≤90 wt %; still more preferably, ≤85 wt %; most preferably, ≤80 wt %) selected from the group consisting of carbonate, bicarbonate, citrate, silicate and mixtures thereof; a nonionic surfactant (preferably, 0.2 to 15 wt %; more preferable, 0.5 to 10 wt %; most preferably, 1.5 to 7.5 wt %); and a dispersant polymer (preferably, 0.5 to 15 wt %; more preferably, 0.5 to 10 wt %; still more preferably, 1 to 8 wt %; yet more preferably, 2 to 6 wt %; most preferably, 3 to 4 wt %) comprising: (a) 5 to 75 wt % (preferably, ≥10 wt %; more preferably, ≥15 wt %; still more preferably, ≥20 wt %; preferably, ≤70 wt %; more preferably, ≤60 wt %; more preferably, ≤50 wt %) of structural units of itaconic acid; (b) 10 to 85 wt % (preferably, ≥15 wt %; more preferably ≥20 wt %; yet more preferably, ≥25 wt %; still more preferably, ≥30 wt %; most preferably, ≥35 wt %; preferably, ≤80 wt %;

more preferably, ≤75 wt %; yet more preferably, ≤70 wt %; most preferably, ≤45 wt %) of structural units having formula I

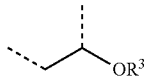

(I)

wherein each $R^3$ is independently selected from a hydrogen and a —C(O)$CH_3$ group; and (c) 10 to 65 wt % (preferably, ≥15 wt %; more preferably, ≥20 wt %; preferably, ≤50 wt %; more preferably, ≤40 wt %; still more preferably, ≤30 wt %) of structural units of (meth)acrylic acid; wherein the dispersant polymer has a lactone end group and wherein the dispersant polymer has a weight average molecular weight of 1,500 to 6,000 (preferably, 1,500 to <5,000; more preferably, 1,750 to 4,500; most preferably, 2,250 to 4,250).

Preferably, the automatic dishwashing composition of the present invention, comprises: a builder. Preferably, the builder used in the automatic dishwashing composition of the present invention, comprises at least one of a carbonate, a citrate and a silicate. Most preferably, the builder used in the automatic dishwashing composition of the present invention, comprises at least one of sodium carbonate, sodium bicarbonate, and sodium citrate.

Preferably, the automatic dishwashing composition of the present invention, comprises: 1 to 97 wt % of a builder. Preferably, the automatic dishwashing composition of the present invention, comprises: ≥1 wt % (more preferably, ≥10 wt %; more preferably, ≥20 wt %; more preferably, ≥25 wt %) of the builder, based on the dry weight of the automatic dishwashing composition. Preferably, the automatic dishwashing composition of the present invention, comprises: ≤95 wt % (preferably, ≤90 wt %; more preferably, ≤85 wt %; most preferably, ≤80 wt %) of the builder, based on the dry weight of the automatic dishwashing composition. Weight percentages of carbonates, citrates and silicates are based on the actual weights of the salts, including metal ions.

The term "carbonate(s)" as used herein and in the appended claims refers to alkali metal or ammonium salts of carbonate, bicarbonate, percarbonate, and/or sesquicarbonate. Preferably, the carbonate used in the automatic dishwashing composition (if any) is selected from the group consisting of carbonate salts of sodium, potassium and lithium (more preferably, salts of sodium or potassium; most preferably, salts of sodium). Percarbonate used in the automatic dishwashing composition (if any) is selected from salts of sodium, potassium, lithium and ammonium (more preferably, salts of sodium or potassium; most preferably, salts of sodium). Most preferably, the carbonate used in the automatic dishwashing composition (if any) is selected from the group consisting of sodium carbonate, sodium bicarbonate, sodium percarbonate and mixtures thereof.

The term "citrate(s)" as used herein and in the appended claims refers to alkali metal citrates. Preferably, the citrate used in the automatic dishwashing composition (if any) is selected from the group consisting of citrate salts of sodium, potassium and lithium (more preferably, salts of sodium or potassium; most preferably, salts of sodium). More preferably, the citrate used in the automatic dishwashing composition (if any) is sodium citrate.

The term "silicate(s)" as used herein and in the appended claims refers to alkali metal silicates. Preferably, the silicate used in the automatic dishwashing composition (if any) is selected from the group consisting of silicate salts of sodium, potassium and lithium (more preferably, salts of sodium or potassium; most preferably, salts of sodium). More preferably, the silicate used in the automatic dishwashing composition (if any) is sodium disilicate. Preferably, the builder used in the automatic dishwashing composition of the present invention includes a silicate. Preferably, when the builder used in the automatic dishwashing composition of the present invention includes a silicate, the automatic dishwashing composition preferably, comprises 0 to 10 wt % (preferably, 0.1 to 5 wt %; more preferably, 0.5 to 3 wt %; most preferably 0.75 to 2.5 wt %) of the silicate(s).

Preferably, the automatic dishwashing composition of the present invention, comprises: 0.2 to 15 wt % (preferably, 0.5 to 10 wt %; more preferably, 1.5 to 7.5 wt %), based on the dry weight of the automatic dishwashing composition, of the nonionic surfactant. More preferably, the automatic dishwashing composition of the present invention, comprises: 0.2 to 15 wt % (preferably, 0.5 to 10 wt %; more preferably, 1.5 to 7.5 wt %), based on the dry weight of the automatic dishwashing composition, of the nonionic surfactant, wherein the surfactant is a fatty alcohol alkoxylate.

Preferably, the nonionic surfactant used in the automatic dishwashing composition of the present invention has a formula selected from $$RO\text{-}(M)_x\text{-}(N)_y\text{—}OH, \text{ and}$$

$$RO\text{-}(M)_x\text{-}(N)_y\text{—}(P)_z\text{—}OH$$

wherein M represents structural units of ethylene oxide, N represents structural units of $C_{3\text{-}18}$ 1,2-epoxyalkane, P represents structural units of $C_{6\text{-}18}$alkyl glycidyl ether, x is 5 to 40, y is 0 to 20, z is 0 to 3 and R represents a $C_{6\text{-}22}$ linear or branched alkyl group.

Preferably, the nonionic surfactant used in the automatic dishwashing composition of the present invention has a formula selected from $$RO\text{-}(M)_x\text{-}(N)_y\text{—}OH, \text{ and}$$

$$RO\text{-}(M)_x\text{-}(N)_y\text{—}O\text{—}R'$$

wherein M and N are structural units derived from alkylene oxides (of which one is ethylene oxide); x is 5 to 40; y is 0 to 20; R represents a $C_{6\text{-}22}$ linear or branched alkyl group; and R' represents a group derived from the reaction of an alcohol precursor with a $C_{6\text{-}22}$ linear or branched alkyl halide, epoxyalkane or glycidyl ether.

Preferably, the nonionic surfactant used in the automatic dishwashing composition of the present invention has a formula $$RO\text{-}(M)_x\text{-}OH$$

wherein M represents structural units of ethylene oxide and x is at least three (preferably, at least five; preferably, no more than ten; more preferably, no more than eight). Preferably, wherein R and R' each have at least eight (more preferably, at least ten) carbon atoms.

Preferably, the automatic dishwashing composition of the present invention, includes a dispersant polymer. More preferably, the automatic dishwashing composition of the present invention, includes: 0.5 to 15 wt %, based on the dry weight of the automatic dishwashing composition, of a dispersant polymer. Still more preferably, the automatic dishwashing composition of the present invention, includes 0.5 to 10 wt %, based on the dry weight of the automatic dishwashing composition of a dispersant polymer. Yet more preferably, the automatic dishwashing composition of the present invention, includes 1 to 8 wt %, based on the dry weight of the automatic dishwashing composition of a dispersant polymer. Still yet more preferably, the automatic dishwashing composition of the present invention, includes 2 to 6 wt %, based on the dry weight of the automatic dishwashing composition of a dispersant polymer. Most preferably, the automatic dishwashing composition of the present invention, includes 3 to 4 wt %, based on the dry weight of the automatic dishwashing composition of a dispersant polymer.

Preferably, the automatic dishwashing composition of the present invention, includes 0.5 to 15 wt % (more preferably, 0.5 to 10 wt %; still more preferably, 1 to 8 wt %; yet more preferably, 2 to 6 wt %; most preferably, 3 to 4 wt %), based on the dry weight of the automatic dishwashing composition of a dispersant polymer, comprising: (a) 5 to 75 wt % (preferably, ≥10 wt %; more preferably, ≥15 wt %; still more preferably, ≥20 wt %; preferably, ≤70 wt %; more preferably, ≤60 wt %; more preferably, ≤50 wt %) of structural units of itaconic acid; (b) b) 10 to 85 wt % (preferably, ≥15 wt %; more preferably ≥20 wt %; yet more preferably, ≥25 wt %; still more preferably, ≥30 wt %; most preferably, ≥35 wt %; preferably, ≤80 wt %; more preferably, ≤75 wt %; yet more preferably, ≤70 wt %; most preferably, ≤45 wt %) of structural units having formula I (I)

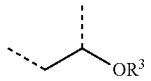

wherein each $R^3$ is independently selected from a hydrogen and a —C(O)$CH_3$ group; and (c) 10 to 65 wt % (preferably, ≥15 wt %; more preferably, ≥20 wt %; preferably, ≤50 wt %; more preferably, ≤40 wt %; still more preferably, ≤30 wt %) of structural units of (meth)acrylic acid (preferably, acrylic acid); wherein the dispersant polymer has a lactone end group and wherein the dispersant polymer has a weight average molecular weight, $M_w$, of 1,500 to 6,000 (preferably, 1,500 to <5,000; more preferably, 1,750 to 4,500; most preferably, 2,250 to 4,250) Daltons.

Preferably, $R^3$ is hydrogen in <100 mol % of the structural units of formula I included in the dispersant polymer. More preferably, $R^3$ is hydrogen in 0 to 50 mol % of the structural units of formula I in the dispersant polymer. Most preferably, $R^3$ is hydrogen in 0 to 40 mol % of the structural units of formula I in the dispersant polymer.

Preferably, the dispersant polymer used in the automatic dishwashing composition of the present invention comprises ≤0.3 wt % (more preferably, ≤0.1 wt %; still more preferably, ≤0.05 wt %; yet still more preferably, ≤0.03 wt %; most preferably, ≤0.01 wt %) of structural units of multi-ethylenically unsaturated crosslinking monomer.

Preferably, the dispersant polymer used in the automatic dishwashing composition of the present invention comprises ≤10 wt % (preferably, ≤5 wt %; more preferably, ≤2 wt %; still more preferably, ≤1 wt %) of structural units of sulfonated monomer. More preferably, the dispersant polymer used in the automatic dishwashing composition of the present invention comprises ≤10 wt % (preferably, ≤5 wt %; more preferably, ≤2 wt %; still more preferably, ≤1 wt %) of structural units of sulfonated monomer selected from the group consisting of 2-acrylamido-2-methylpropane sulfonic acid (AMPS), 2-methacrylamido-2-methylpropane sulfonic acid, 4-styrenesulfonic acid, vinylsulfonic acid, 3-allyloxy sulfonic acid, 2-hydroxy-1-propane sulfonic acid (HAPS), 2-sulfoethyl(meth)acrylic acid, 2-sulfopropyl(meth)acrylic acid, 3-sulfopropyl(meth)acrylic acid, 4-sulfobutyl(meth) acrylic acid and salts thereof. Most preferably, the dispersant polymer used in the automatic dishwashing composition of the present invention comprises ≤10 wt % (preferably, ≤5 wt %; more preferably, ≤2 wt %; still more preferably, ≤1 wt %) of structural units of 2-acrylamido-2-methylpropane sulfonic acid (AMPS) monomer.

Preferably, the dispersant polymer used in the automatic dishwashing composition of the present invention comprises ≤8 wt % (preferably, ≤5 wt %; more preferably, ≤3 wt %; most preferably, ≤1 wt %) of structural units of esters of (meth)acrylic acid.

Preferably, the dispersant polymer used in the automatic dishwashing composition of the present invention comprises ≤8 wt % (preferably, ≤5 wt %; more preferably, ≤3 wt %; most preferably, ≤1 wt %) of structural units of esters of itaconic acid.

Preferably, the dispersant polymer used in the automatic dishwashing composition of the present invention has a lactone end group. Preferably, the lactone end group is one produced by an internal esterification reaction between a carboxylic acid group on a polymerized carboxylic acid monomer residue and a terminal hydroxy group derived from a chain transfer agent. Most preferably, the lactone end group is a γ-lactone.

Preferably, the dispersant polymer used in the automatic dishwashing composition of the present invention has a formula II (II)

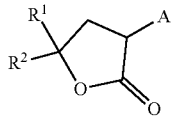

wherein A is a polymer chain comprising the structural units of itaconic acid, the structural units of vinyl acetate and the structural units of (meth)acrylic acid; $R^1$ and $R^2$ are independently a H or a $C_{1-4}$ alkyl group. Most preferably, the dispersant polymer used in the automatic dishwashing composition of the present invention has a formula II, wherein A is a polymer chain comprising the structural units of itaconic acid, the structural units of vinyl acetate and the structural units of (meth)acrylic acid; wherein $R^1$ is methyl; and wherein $R^2$ is methyl.

Preferably, the dispersant polymer used in the automatic dishwashing composition of the present invention is produced by solution polymerization. Preferably, the dispersant polymer is a random copolymer. Preferably, the solvent used in the synthesis of the dispersant polymer is selected from aqueous 2-propanol, aqueous ethanol, anhydrous 2-propanol, anhydrous ethanol and mixtures thereof.

Preferably, the dispersant polymer used in the automatic dishwashing composition of the present invention is provided in the form of a water-soluble solution polymer, a slurry, a dried powder, granules or another solid form.

The automatic dishwashing composition of the present invention, optionally further comprises: an additive. Preferably, the automatic dishwashing composition of the present invention, further comprises: an additive selected from the group consisting of an alkaline source; a bleaching agent (e.g., sodium percarbonate, sodium perborate); a bleach activator (e.g., tetraacetylethylenediamine (TAED)); a bleach catalyst (e.g., manganese(II) acetate, cobalt(II) chloride, bis(TACN)magnesium trioxide diacetate); an enzyme (e.g., protease, amylase, lipase, or cellulase); a phosphonate (e.g., 1-hydroxy ethylidene-1,1-diphosphonic acid (HEDP)); a foam suppressant; a coloring agent; a fragrance; a silicate; an additional builder; an antibacterial agent; a filler; a deposit control polymer and mixtures thereof. More preferably, the automatic dishwashing composition of the present invention, further comprises an additive, wherein the additive includes a bleaching agent (e.g., sodium percarbonate, sodium perborate); a bleach activator (e.g., tetraacetylethylenediamine (TAED)) and an enzyme (e.g., protease, amylase, lipase, or cellulase). Most preferably, the automatic dishwashing composition of the present invention, further comprises an additive, wherein the additive includes a bleaching agent, wherein the bleaching agent includes sodium percarbonate; a bleach activator, wherein the bleach activator includes tetraacetylethylenediamine (TAED); and an enzyme, wherein the enzyme includes a protease and an amylase.

Fillers included in tablets or powders are inert, water-soluble substances, typically sodium or potassium salts (e.g., sodium sulfate, potassium sulfate, sodium chloride, potassium chloride). In tablets and powders, fillers are typically present in amounts ranging from 0 wt % to 75 wt %. Fillers included in gel formulations typically include those mentioned for use in tablets and powders and also water. Fragrances, dyes, foam suppressants, enzymes and antibacterial agents usually total no more than 10 wt %, alternatively no more than 5 wt %, of the automatic dishwashing composition.

The automatic dishwashing composition of the present invention, optionally further comprises: an alkaline source. Suitable alkaline sources include, without limitation, alkali metal carbonates and alkali metal hydroxides, such as sodium or potassium carbonate, bicarbonate, sesquicarbonate, sodium, lithium, or potassium hydroxide, or mixtures of the foregoing. Sodium hydroxide is preferred. The amount of alkaline source in the automatic dishwashing composition of the present invention (if any) is at least 1 wt % (preferably, at least 20 wt %) and up to 80 wt % (preferably, up to 60 wt %), based on the dry weight of the automatic dishwashing composition.

The automatic dishwashing composition of the present invention, optionally further comprises: a bleaching agent (e.g., sodium percarbonate). The amount of the bleaching agent in the automatic dishwashing composition of the present invention (if any) is preferably at a concentration of 1 to 25 wt % (more preferably, 5 to 20 wt %), based on the dry weight of the automatic dishwashing composition.

The automatic dishwashing composition of the present invention, optionally further comprises: a bleach activator (e.g., tetraacetylethylenediamine (TAED)). The amount of the bleach activator in the automatic dishwashing composition of the present invention (if any) is preferably at a concentration of 1 to 10 wt % (more preferably, 2.5 to 7.5 wt %), based on the dry weight of the automatic dishwashing composition.

The automatic dishwashing composition of the present invention, optionally further comprises: a deposit control polymer, useful for controlling insoluble deposits in automatic dishwashers. Preferable deposit control polymers include polymers comprising combinations of structural units of at least one of acrylic acid, methacrylic acid, diacid monomers (e.g., maleic acid), esters of acrylic or methacrylic acid (e.g., polyethylene glycol esters), styrene, sulfonated monomers (e.g., AMPS), substituted acrylamides and substituted methacrylamides.

Preferably, the automatic dishwashing composition of the present invention comprises ≤1 wt % (preferably, ≤0.5 wt %; more preferably, ≤0.2 wt %; still more preferably, ≤0.1 wt %; yet still more preferably, ≤0.01 wt %; most preferably, <the detectable limit) of phosphate (measured as elemental phosphorus). Preferably, the automatic dishwashing composition of the present invention is phosphate free.

Preferably, the automatic dishwashing composition of the present invention comprises <the detectable limit of builders selected from the group consisting of nitrilotriacetic acid; ethylenediaminetetraacetic acid; diethylenetriaminepentaacetic acid; glycine-N,N-diacetic acid; methyl glycine-N,N-diacetic acid; 2-hydroxyethyliminodiacetic acid; glutamic acid-N,N-diacetic acid; 3-hydroxy-2,2'-iminodissuccinate; S,S-ethylenediaminedisuccinate aspartic acid-diacetic acid; N,N'-ethylene diamine disuccinic acid; iminodisuccinic acid; aspartic acid; aspartic acid-N,N-diacetic acid; beta-alaninediacetic acid; polyaspartic acid; salts thereof and mixtures thereof. More preferably, the automatic dishwashing composition of the present invention contains 0 wt % of builders selected from the group consisting of nitrilotriacetic acid; ethylenediaminetetraacetic acid; diethylenetriaminepentaacetic acid; glycine-N,N-diacetic acid; methyl glycine-N,N-diacetic acid; 2-hydroxyethyliminodiacetic acid; glutamic acid-N,N-diacetic acid; 3-hydroxy-2,2'-iminodissuccinate; S,S-ethylenediaminedisuccinate aspartic acid-diacetic acid; N,N'-ethylene diamine disuccinic acid; iminodisuccinic acid; aspartic acid; aspartic acid-N,N-diacetic acid; beta-alaninediacetic acid; polyaspartic acid; salts thereof and mixtures thereof.

Preferably, the automatic dishwashing composition of the present invention comprises ≤2 wt % (more preferably, ≤1.5 wt %; most preferably, ≤1 wt %) of low molecular weight (i.e., <1,000 Daltons) phosphonate compounds (e.g., 1-hydroxyethylidene-1,1-diphosphonic acid (HEDP) and its salts).

Preferably, the automatic dishwashing composition of the present invention has a pH (at 1 wt % in water) of at least 9 (preferably, ≥10; more preferably, ≥11.5). Preferably, the automatic dishwashing composition of the present invention has a pH (at 1 wt % in water) of no greater than 13.

Preferably, the automatic dishwashing composition of the present invention can be formulated in any typical form, e.g., as a tablet, powder, block, monodose, sachet, paste, liquid or gel. The automatic dishwashing compositions of the present invention are useful for cleaning ware, such as eating and cooking utensils, dishes, in an automatic dishwashing machine.

Preferably, the automatic dishwashing composition of the present invention are suitable for use under typical operating conditions. For example, when used in an automatic dishwashing machine, typical water temperatures during the washing process preferably are from 20° C. to 85° C., preferably 30° C. to 70° C. Typical concentrations for the automatic dishwashing composition as a percentage of total liquid in the dishwasher preferably are from 0.1 to 1 wt %, preferably from 0.2 to 0.7 wt %. With selection of an appropriate product form and addition time, the automatic dishwashing compositions of the present invention may be present in the prewash, main wash, penultimate rinse, final rinse, or any combination of these cycles.

Preferably, the method of cleaning an article in an automatic dishwashing machine of the present invention, comprises: providing at least one article (e.g., cookware, bakeware, tableware, dishware, flatware and/or glassware); providing an automatic dishwashing composition of the present invention; and applying the automatic dishwashing composition to the at least one article (preferably, in an automatic dishwasher).

Some embodiments of the present invention will now be described in detail in the following Examples.

The weight average molecular weight, $M_W$; number average molecular weight, $M_N$; and polydispersity (PDI) values reported in the Examples were measured by gel permeation chromatography (GPC) on an Agilent 1100 series LC system equipped with an Agilent 1100 series refractive index. Samples were dissolved in HPCL grade THF/FA mixture (100:5 volume/volume ratio) at a concentration of approximately 9 mg/mL and filtered through at 0.45 μm syringe filter before injection through a 4.6×10 mm Shodex KF guard column, a 8.0×300 mm Shodex KF 803 column, a 8.0×300 mm Shodex KF 802 column and a 8.0×100 mm Shodex KF-D column. A flow rate of 1 mL/min and temperature of 40° C. were maintained. The columns were calibrated with narrow molecular weight PS standards (Easi-Cal PS-2, Polymer Laboratories, Inc.).

Comparative Example C1

Synthesis of Terpolymer

To a glass vessel contained within a stainless steel jacket equipped with an overhead stirrer, a nitrogen bubbler, a pressure controller, a reflux condenser and a temperature controller was added 2-propanol (21.84 g), itaconic acid (10.04 g) and vinyl acetate (5.03 g). The temperature controller set point was set at 25° C. The overhead stirrer was set at 250 rpm. The pressure controller was set to provide a pressure on the flask contents of 30 psig. Then a solution of tert-butyl peroxypivilate (0.58 g) in 2-propanol (2.02 g) was added to the flask contents and the temperature controller set point was raised to 70° C. After 5, minutes, the temperature controller set point was further raised to 80° C. To the flask contents was then added via syringe pump a monomer mixture of acrylic acid (5.03 g), vinyl acetate (5.03 g) and 2-propanol (5.17 g) over a period of 260 minutes, and an initiator solution of tert-butyl peroxypivalate (1.17 g) in 2-propanol (4.09 g) over a period of 320 minutes. After the initiator addition ceased, the flask contents were maintained for 120 minutes. The flask contents were then depressurized to atmospheric pressure and allowed to cool down to room temperature. The resulting solids were then measured at 42.53 wt %. The product polymer was then recovered by precipitation into n-hexane. The collected polymer was dried in a vacuum oven, at 80° C., for 5 days. The weight average molecular weight, $M_W$, and the number average molecular weight, $M_N$, of the dried polymer were then measured with the results provided in Table 1 along with the calculated polydispersity index (PDI) for the dried polymer. The dried polymer was then neutralized by adding to DI water with stirring and adjusting the pH to 7.14 with 50 wt % NaOH solution. The final % solids of the aqueous solution was measured at 28.5 wt %.

Comparative Example C2

Synthesis of Terpolymer

To a glass vessel contained within a stainless steel jacket equipped with an overhead stirrer, a nitrogen bubbler, a pressure controller, a reflux condenser and a temperature controller was added 2-propanol (19.93 g), itaconic acid (5.02 g) and vinyl acetate (7.54 g). The temperature controller set point was set at 25° C. The overhead stirrer was set at 250 rpm. The pressure controller was set to provide a pressure on the flask contents of 30 psig. Then a solution of tert-butyl peroxypivilate (0.58 g) in 2-propanol (2.02 g) was added to the flask contents and the temperature controller set point was raised to 70° C. After 5, minutes, the temperature controller set point was further raised to 80° C. To the flask contents was then added via syringe pump a monomer mixture of acrylic acid (5.11 g), vinyl acetate (7.47 g) and 2-propanol (7.09 g) over a period of 120 minutes, and an initiator solution of tert-butyl peroxypivalate (1.17 g) in 2-propanol (4.09 g) over a period of 180 minutes. After the initiator addition ceased, the flask contents were maintained for 120 minutes. The flask contents were then depressurized to atmospheric pressure and allowed to cool down to room temperature. The resulting solids were then measured at 44.39 wt %. The product polymer was then recovered by precipitation into n-hexane. The collected polymer was dried in a vacuum oven, at 80° C., for 5 days. The weight average molecular weight, $M_W$, and the number average molecular weight, $M_N$, of the dried polymer were then measured with the results provided in Table 1 along with the calculated polydispersity index (PDI) for the dried polymer. The dried polymer was then neutralized by adding to DI water with stirring and adjusting the pH to 7 with 50 wt % NaOH. The final % solids of the aqueous solution was measured at 26.79 wt %.

Example 1

Synthesis of Dispersant Polymer

To a glass vessel contained within a stainless steel jacket equipped with an overhead stirrer, a nitrogen bubbler, a pressure controller, a reflux condenser and a temperature controller was added 2-propanol (16.84 g), itaconic acid (10.04 g) and vinyl acetate (5.03 g). The temperature controller set point was set at 25° C. The overhead stirrer was set at 250 rpm. The pressure controller was set to provide a pressure on the flask contents of 30 psig. Then a solution of tert-butyl peroxypivilate (0.95 g) in 2-propanol (3.29 g) was added to the flask contents and the temperature controller set point was raised to 70° C. After 5, minutes, the temperature controller set point was further raised to 80° C. To the flask contents was then added via syringe pump a monomer mixture of acrylic acid (5.03 g), vinyl acetate (5.03 g) and 2-propanol (5.17 g) over a period of 260 minutes, and an initiator solution of tert-butyl peroxypivalate (1.92 g) in 2-propanol (6.69 g) over a period of 320 minutes. After the initiator addition ceased, the flask contents were maintained for 120 minutes. The flask contents were then depressurized to atmospheric pressure and allowed to cool down to room temperature. The resulting solids were then measured at 45.04 wt %. The product polymer was then recovered by precipitation into n-hexane. The collected polymer was dried in a vacuum oven, at 80° C., for 5 days. The weight average molecular weight, $M_W$, and the number average molecular weight, $M_N$, of the polymer in reaction mixture was then measured with the results provided in Table 1 along with the calculated polydispersity index (PDI). The dried polymer was then neutralized by adding to DI water with stirring and adjusting the pH to 7.38 with 50 wt % NaOH solution. The final % solids of the aqueous solution was measured at 27.02 wt %.

Example 2

Synthesis of Dispersant Polymer

To a glass vessel contained within a stainless steel jacket equipped with an overhead stirrer, a nitrogen bubbler, a pressure controller, a reflux condenser and a temperature controller was added 2-propanol (10.6 g), itaconic acid (10.04 g) and vinyl acetate (5.03 g). The temperature controller set point was set at 25° C. The overhead stirrer was set at 250 rpm. The pressure controller was set to provide a pressure on the flask contents of 30 psig. Then a solution of tert-butyl peroxypivilate (0.58 g) in 2-propanol (2.02 g) and a solution of mercaptoethanol (0.13 g) in 2-propanol (3.57 g) were added to the flask contents and the temperature controller set point was raised to 70° C. After 5, minutes, the temperature controller set point was further raised to 80° C. To the flask contents was then added via syringe pump a monomer mixture of acrylic acid (5.03 g), vinyl acetate (5.03 g) and 2-propanol (5.17 g) over a period of 260 minutes, an initiator solution of tert-butyl peroxypivalate (1.17 g) in 2-propanol (4.09 g) over a period of 320 minutes and a solution of mercaptoethanol (0.255 g) in 2-propanol (7.245 g) over a period of 320 minutes. After the initiator addition ceased, the flask contents were maintained for 120 minutes. The flask contents were then depressurized to atmospheric pressure and allowed to cool down to room temperature. The resulting solids were then measured at 42.09 wt %. The product polymer was then recovered by precipitation into n-hexane. The collected polymer was dried in a vacuum oven, at 80° C., for 5 days. The weight average molecular weight, $M_W$, and the number average molecular weight, $M_N$, of the polymer in reaction mixture was then measured with the results provided in Table 1 along with the calculated polydispersity index (PDI). The dried polymer was then neutralized by adding to DI water with stirring and adjusting the pH to 7.45 with 50 wt % NaOH solution. The final % solids of the aqueous solution was measured at 26.24 wt %.

Example 3

Synthesis of Dispersant Polymer

To a glass vessel contained within a stainless steel jacket equipped with an overhead stirrer, a nitrogen bubbler, a pressure controller, a reflux condenser and a temperature controller was added 2-propanol (14.92 g), itaconic acid (5.02 g) and vinyl acetate (7.54 g). The temperature controller set point was set at 25° C. The overhead stirrer was set at 250 rpm. The pressure controller was set to provide a pressure on the flask contents of 30 psig. Then a solution of tert-butyl peroxypivilate (0.96 g) in 2-propanol (3.34 g) was added to the flask contents and the temperature controller set point was raised to 70° C. After 5, minutes, the temperature controller set point was further raised to 80° C. To the flask contents was then added via syringe pump a monomer mixture of acrylic acid (5.11 g), vinyl acetate (7.47 g) and 2-propanol (7.09 g) over a period of 120 minutes, and an initiator solution of tert-butyl peroxypivalate (1.92 g) in 2-propanol (6.68 g) over a period of 180 minutes. After the initiator addition ceased, the flask contents were maintained for 120 minutes. The flask contents were then depressurized to atmospheric pressure and allowed to cool down to room temperature. The resulting solids were then measured at 44.98 wt %. The product polymer was then recovered by precipitation into n-hexane. The collected polymer was dried in a vacuum oven, at 80° C., for 5 days. The weight average molecular weight, $M_W$, and the number average molecular weight, $M_N$, of the polymer in reaction mixture was then measured with the results provided in Table 1 along with the calculated polydispersity index (PDI). The dried polymer was then neutralized by adding to DI water with stirring and adjusting the pH to 7.26 with 50 wt % NaOH solution. The final % solids of the aqueous solution was measured at 28.04 wt %.

Example 4

Synthesis of Dispersant Polymer

To a glass vessel contained within a stainless steel jacket equipped with an overhead stirrer, a nitrogen bubbler, a pressure controller, a reflux condenser and a temperature controller was added 2-propanol (8.82 g), itaconic acid (5.02 g) and vinyl acetate (7.54 g). The temperature controller set point was set at 25° C. The overhead stirrer was set at 250 rpm. The pressure controller was set to provide a pressure on the flask contents of 30 psig. Then a solution of tert-butyl peroxypivilate (0.58 g) in 2-propanol (2.02 g) and a solution of mercaptoethanol (0.13 g) in 2-propanol (3.57 g) were added to the flask contents and the temperature controller set point was raised to 70° C. After 5, minutes, the temperature controller set point was further raised to 80° C. To the flask contents was then added via syringe pump a monomer mixture of acrylic acid (5.11 g), vinyl acetate (7.47 g) and 2-propanol (7.09 g) over a period of 120 minutes, an initiator solution of tert-butyl peroxypivalate (1.17 g) in 2-propanol (4.09 g) over a period of 180 minutes and a solution of mercaptoethanol (0.255 g) in 2-propanol (7.245 g) over a period of 180 minutes. After the initiator addition ceased, the flask contents were maintained for 120 minutes. The flask contents were then depressurized to atmospheric pressure and allowed to cool down to room temperature. The resulting solids were then measured at 44.18 wt %. The product polymer was then recovered by precipitation into n-hexane. The collected polymer was dried in a vacuum oven, at 80° C., for 5 days. The weight average molecular weight, $M_W$, and the number average molecular weight, $M_N$, of the polymer in reaction mixture was then measured with the results provided in Table 1 along with the calculated polydispersity index (PDI). The dried polymer was then neutralized by adding to DI water with stirring and adjusting the pH to 7.33 with 50 wt % NaOH solution. The final % solids of the aqueous solution was measured at 27.97 wt %.

TABLE 1

| | Monomer Feed composition (wt %) | | | Molecular Weight (Da) | | |
|---|---|---|---|---|---|---|
| Example | Vac | IA | AA | Wt avg | Num. avg | PDI |
| Comp. C1 | 40 | 40 | 20 | 6,600 | 2,800 | 2.36 |
| Comp. C2 | 60 | 20 | 20 | 6,900 | 3,100 | 2.23 |
| 1 | 40 | 40 | 20 | 3,550 | 1,600 | 2.22 |
| 2 | 40 | 40 | 20 | 2,550 | 1,300 | 1.96 |
| 3 | 60 | 20 | 20 | 4,950 | 2,100 | 2.4 |
| 4 | 60 | 20 | 20 | 4,050 | 1,700 | 2.4 |

Procedure for Preparing Food Soil

The STIWA food soil described in TABLE 2 was prepared by the following procedure.

a) Bringing the water to a boil.
b) Mixing in a paper cup the instant gravy, the benzoic acid and the starch; and then adding the mixture to the boiling water.
c) Adding the milk and margarine to the product of (b).
d) Letting the product of (c) cool down to approximately 40° C., and then adding mixture to a kitchen mixer (Polytron).
e) Combining in another paper cup, the egg yolk, the ketchup and the mustard and mixing with a spoon.
f) Adding the product of (e) to the mixture of (d) in the blender with continuous stirring.
g) Letting the product of (f) stir in the blender for 5 minutes.
h) The freezing the product food soil mixture from 7.
i) The frozen slush is placed into the dishwasher at the time indicated below.

TABLE 2

| Ingredient | Weight, g |
|---|---|
| Water | 700 |
| Margarine | 100 |
| Gravy Powder | 25 |
| Potato Starch | 5 |
| Benzoic Acid | 1 |
| Egg Yolk | 3 |
| Mustard | 25 |
| Ketchup | 25 |
| Milk | 50 |

Comparative Examples DC1-DC3 and Examples D1-D4

Dishwashing Compositions

Dishwashing compositions were prepared in each of Comparative Examples DC1-DC3 and Examples D1-D4 having the component formulations identified in TABLE 3. The protease used in each of the component formulations was Savinase® 12T protease available from Novozymes. The amylase used in each of the component formulations was Stainzyme® 12T amylase available from Novozymes.

TABLE 3

| | Concentration on solids basis (wt %) | | | | | | |
|---|---|---|---|---|---|---|---|
| Ingredient | DC1 | DC2 | DC3 | D1 | D2 | D3 | D4 |
| Sodium Citrate | 20 | 20 | 20 | 20 | 20 | 20 | 20 |
| Sodium Carbonate | 40 | 40 | 40 | 40 | 40 | 40 | 40 |
| Percarbonate | 15 | 15 | 15 | 15 | 15 | 15 | 15 |
| TAED | 4 | 4 | 4 | 4 | 4 | 4 | 4 |
| Sodium Disilicate[a] | 1 | 1 | 1 | 1 | 1 | 1 | 1 |
| Sodium Sulfate | 7.5 | 7.5 | 7.5 | 7.5 | 7.5 | 7.5 | 7.5 |
| Nonionic Surfactant[b] | 5 | 5 | 5 | 5 | 5 | 5 | 5 |
| HEDP[c] | 1 | 1 | 1 | 1 | 1 | 1 | 1 |
| Amylase | 1 | 1 | 1 | 1 | 1 | 1 | 1 |
| Protease | 2 | 2 | 2 | 2 | 2 | 2 | 2 |
| Dispersant Polymer[d] | — | — | 3.5 | — | — | — | — |
| Comp. Example C1 | 3.5 | — | — | — | — | — | — |
| Comp. Example C2 | — | 3.5 | — | — | — | — | — |
| Example 1 | — | — | — | 3.5 | — | — | — |
| Example 2 | — | — | — | — | 3.5 | — | — |

TABLE 3-continued

| | Concentration on solids basis (wt %) | | | | | | |
|---|---|---|---|---|---|---|---|
| Ingredient | DC1 | DC2 | DC3 | D1 | D2 | D3 | D4 |
| Example 3 | — | — | — | — | — | 3.5 | — |
| Example 4 | — | — | — | — | — | — | 3.5 |

[a]Britesil ® H20 hydrous sodium silicate available from PQ Corporation.
[b]Dowfax ™ 20B102 nonionic linear alcohol alkoxylate available from The Dow Chemical Company.
[c]Dequest ™ 2010 organophosphonate available from Italmatch Chemicals S.p.A.
[d]Acusol ™ 588 dispersant (polyacrylate copolymer) available from The Dow Chemical Company Dishwashing Test Conditions Machine: Miele SS-ADW, Model G1222SC Labor. Program: 1 at 65° C. wash cycle with heated wash for 8 min, fuzzy logic disengaged, heated dry. Water: 375 ppm hardness (as $CaCO_3$, confirmed by EDTA titration), Ca:Mg=3:1. Food soil: 50 g of the composition noted in TABLE 2 was introduced to the wash liquor at t=15 minutes frozen in a cup. Each dishwashing composition from Comparative Examples DC1-DC3 and Examples D1-D4 were tested, dosed at 20 g per wash.

Filming and Spotting Evaluation

After 15 wash cycles under the above dishwashing test conditions, the glass tumblers were dried in open air. After drying in open air filming and spotting ratings were determined by trained evaluators by observations of glass tumblers in a light box with controlled illumination from below. Glass tumblers were rated for filming and spotting according to ASTM method ranging from 1 (no film/spots) to 5 (heavily filmed/spotted). An average value of 1 to 5 for filming and spotting was determined for each glass tumbler and are reported in TABLE 4.

TABLE 4

| Dishwashing Composition | Filming (15 Cycles) | Spotting (15 Cycles) |
|---|---|---|
| Comp. Example DC1 | 3.25 | 1.5 |
| Comp. Example DC2 | 3.25 | 1.5 |
| Comp. Example DC3 | 2.3 | 2.1 |
| Example D1 | 1.5 | 3.25 |
| Example D2 | 1.6 | 2.5 |
| Example D3 | 1.5 | 3.25 |
| Example D4 | 1.6 | 2.5 |

We claim:

1. An automatic dishwashing composition, comprising:

a builder selected from the group consisting of carbonate, bicarbonate, citrate, silicate and mixtures thereof;

a nonionic surfactant; and a dispersant polymer comprising:

(a) 5 to 75 wt % of structural units of itaconic acid;

(b) 15 to 45 wt % of structural units having formula I (I)

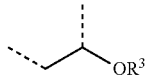

wherein each $R^3$ is independently selected from a hydrogen and a —C(O)$CH_3$ group; and (c) 10 to 65 wt % of structural units of (meth)acrylic acid;

wherein the dispersant polymer has a lactone end group and wherein the dispersant polymer has a weight average molecular weight of 2,250 to 4,250.

2. The automatic dishwashing composition of claim 1, wherein $R^3$ is hydrogen in 0 to 50 mol % of the structural units of formula I in the dispersant polymer.

3. The automatic dishwashing composition of claim 1, wherein the automatic dishwashing composition contains less than 0.1 wt % phosphate, measured as elemental phosphorus.

4. The automatic dishwashing composition of claim 1, wherein the automatic dishwashing composition contains 0 wt % of builders selected from the group consisting of nitrilotriacetic acid; ethylenediaminetetraacetic acid; diethylenetriaminepentaacetic acid; glycine-N,N-diacetic acid; methyl glycine-N,N-diacetic acid; 2-hydroxyethyliminodiacetic acid; glutamic acid-N,N-diacetic acid; 3-hydroxy-2,2'-iminodissuccinate; S,S-ethylenediaminedisuccinate aspartic acid-diacetic acid; N,N'-ethylene diamine disuccinic acid; iminodisuccinic acid; aspartic acid; aspartic acid-N,N-diacetic acid; beta-alaninediacetic acid; polyaspartic acid; salts thereof and mixtures thereof; and, wherein the automatic dishwashing composition contains less than 0.1 wt % phosphate, measured as elemental phosphorus.

5. The automatic dishwashing composition of claim 4, wherein the lactone end group is a γ-lactone.

6. The automatic dishwashing composition of claim 5, wherein the dispersant polymer has formula II

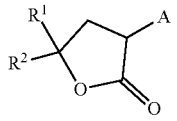

(II)

wherein A is a polymer chain comprising the structural units of itaconic acid, the structural units having formula I and the structural units of (meth)acrylic acid; wherein $R^1$ is methyl; and wherein $R^2$ is methyl.

7. The automatic dishwashing composition of claim 6, further comprising an additive selected from the group consisting of a bleaching agent, a bleach activator, an enzyme, a filler, and mixtures thereof.

8. A method of cleaning an article in an automatic dishwashing machine, comprising:

providing at least one article;

providing an automatic dishwashing composition according to claim 1; and, applying the automatic dishwashing composition to the at least one article.

* * * * *